US012281421B2

(12) United States Patent
Minematsu et al.

(10) Patent No.: US 12,281,421 B2
(45) Date of Patent: Apr. 22, 2025

(54) STORAGE MEDIUM STORING DISPLAY PROGRAM, DISPLAY METHOD, AND DISPLAY APPARATUS

(71) Applicant: BROTHER KOGYO KABUSHIKI KAISHA, Nagoya (JP)

(72) Inventors: Yoshihiro Minematsu, Nagoya (JP); Kazutaka Imaizumi, Nagoya (JP); Kazuki Shibata, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/347,860

(22) Filed: Jul. 6, 2023

(65) Prior Publication Data

US 2024/0035215 A1 Feb. 1, 2024

(30) Foreign Application Priority Data

Jul. 29, 2022 (JP) ..... 2022-121274

(51) Int. Cl.
*D05B 19/12* (2006.01)
*D05B 19/08* (2006.01)

(52) U.S. Cl.
CPC ..... *D05B 19/12* (2013.01); *D05B 19/08* (2013.01); *D05D 2205/16* (2013.01)

(58) Field of Classification Search
CPC ..... D05B 59/00; D05B 19/04; D05B 19/12; D05B 43/00; D05B 19/08; D05B 19/10
See application file for complete search history.

(56) References Cited

U.S. PATENT DOCUMENTS 4,166,423 A * 9/1979 Brienza ..... D05B 47/04 112/254
4,869,188 A * 9/1989 Hyodo ..... D05B 19/105 112/458
7,918,387 B2 * 4/2011 Kahn ..... G06K 19/06046 235/375
7,983,782 B2 * 7/2011 Nomura ..... B65H 49/04 700/136
9,435,062 B2 * 9/2016 Kongo ..... D05B 19/04
(Continued)

FOREIGN PATENT DOCUMENTS

JP 2012-165807 A 9/2012
JP 2013034697 A * 2/2013 ..... D05B 19/10
(Continued)

*Primary Examiner* — Danny Worrell
(74) *Attorney, Agent, or Firm* — Oliff PLC

(57) ABSTRACT

A non-transitory computer-readable storage medium stores a display program including a set of program instructions for a display apparatus. The display apparatus includes a camera, a display, and a controller. The set of program instructions, when executed by the controller, causes the display apparatus to perform: acquiring a shot image representing a real space, the shot image being an image shot by the camera; acquiring target information indicating a thread spool of a detection target; detecting a thread spool position on the shot image for the thread spool of the detection target, based on the shot image and the target information; generating a display image based on the shot image, the display image indicating the thread spool position; and displaying the display image on the display.

20 Claims, 8 Drawing Sheets

(56) References Cited

U.S. PATENT DOCUMENTS

| | | | | |
|---|---|---|---|---|
| 2004/0000264 | A1* | 1/2004 | Sakakibara | D05B 43/00 112/453 |
| 2005/0188906 | A1* | 9/2005 | Goto | D05B 19/12 112/102.5 |
| 2010/0017011 | A1* | 1/2010 | Goldman | D05B 19/08 700/138 |
| 2010/0313803 | A1* | 12/2010 | Okuyama | D05B 19/12 112/102.5 |
| 2011/0048300 | A1* | 3/2011 | Tokura | D05C 5/06 112/102.5 |
| 2011/0048304 | A1* | 3/2011 | Kato | D05B 91/16 206/389 |
| 2015/0345057 | A1* | 12/2015 | Kongo | D05B 43/00 700/137 |
| 2018/0016720 | A1* | 1/2018 | Okuyama | D05B 19/12 |

FOREIGN PATENT DOCUMENTS

| | | | | |
|---|---|---|---|---|
| JP | 2014068803 | A | * | 4/2014 |
| JP | 2015-228880 | A | | 12/2015 |

* cited by examiner

FIG. 3

T1 T2 T3

| NO | COLOR | ··· |
|---|---|---|
| 001 | WHITE | ··· |
| ⋮ | ⋮ | ⋮ |
| 079 | SALMON PINK | ··· |
| ⋮ | ⋮ | ⋮ |
| 328 | BRASS | ··· |
| ⋮ | ⋮ | ⋮ |
| 502 | MINT GREEN | ··· |
| 513 | LIME GREEN | ··· |
| ⋮ | ⋮ | ⋮ |
| 604 | LILAC | ··· |
| ⋮ | ⋮ | ⋮ |
| 804 | LAVENDER | ··· |
| 807 | CARMINE | ··· |
| ⋮ | ⋮ | ⋮ |

T

FIG. 5

P

| NO (D1) | COLOR (D2) | COORDINATE DATA (D3) |
|---|---|---|
| 1 | BRASS | COORDINATE DATA |
| 2 | LAVENDER | COORDINATE DATA |
| 3 | LILAC | COORDINATE DATA |
| 4 | SALMON PINK | COORDINATE DATA |
| 5 | CARMINE | COORDINATE DATA |
| 6 | LIME GREEN | COORDINATE DATA |
| 7 | MINT GREEN | COORDINATE DATA |
| 8 | LILAC | COORDINATE DATA |

D

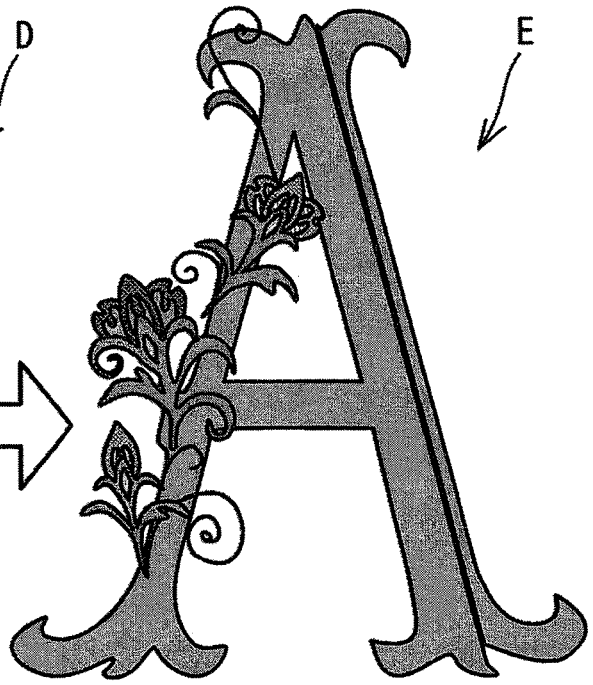

E

FIG. 6

QB

| ID (Q1) | COLOR (Q2) |
|---|---|
| 1 | BLACK |
| 2 | BROWN |
| 3 | WHITE |
| 4 | MINT GREEN |
| 5 | GREEN |
| 6 | PINK |
| 7 | YELLOW |
| 8 | CARMINE |
| 9 | LIME GREEN |
| 10 | RED |

R

| NO (R1) | ID (R2) | COLOR (R3) |
|---|---|---|
| 1 | 2 | BRASS |
| 2 | 3 | LAVENDER |
| 3 | 5 | LILAC |
| 4 | 6 | SALMON PINK |

QA

| ID (Q1) | COLOR (Q2) |
|---|---|
| 1 | BLACK |
| 2 | BRASS |
| 3 | LAVENDER |
| 4 | MINT GREEN |
| 5 | LILAC |
| 6 | SALMON PINK |
| 7 | YELLOW |
| 8 | CARMINE |
| 9 | LIME GREEN |
| 10 | RED |

STORAGE MEDIUM STORING DISPLAY PROGRAM, DISPLAY METHOD, AND DISPLAY APPARATUS

REFERENCE TO RELATED APPLICATIONS

This application claims priority from Japanese Patent Application No. 2022-121274 filed on Jul. 29, 2022. The entire content of the priority application is incorporated herein by reference.

BACKGROUND ART

A sewing machine system including a sewing machine is known.

DESCRIPTION

A sewing machine system includes a sewing machine, a storage case, a detector, a detection result transmitter, a detection result receiver, and a display in order to facilitate the work of searching for a necessary thread spool when replacing threads during sewing. The storage case is formed separately from the sewing machine. The storage case has a plurality of storage sections partitioned into grids. The detector detects the type of thread spool stored in the storage section in association with a stored position in the storage case. The detection result transmitter transmits the detection result detected by the detector to the sewing machine. The detection result receiver is provided in the sewing machine and receives the detection result from the detection result transmitter. The display displays the type of thread spool required during sewing and the stored position in the storage case, based on the detection result.

In the above sewing machine system, in order to detect thread spools, the thread spools need to be stored in the dedicated storage case.

In view of the foregoing, an example of an object of this disclosure is to provide a storage medium storing a display program, a display method, and a display apparatus configured to detect a thread spool to be used for sewing from among a plurality of thread spools arranged at an arbitrary location and to display a detection result.

According to one aspect, this specification discloses a non-transitory computer-readable storage medium storing a display program including a set of program instructions for a display apparatus comprising a camera, a display, and a controller. The set of program instructions, when executed by the controller, causes the display apparatus to perform acquiring a shot image representing a real space. The shot image is an image shot by the camera. Thus, the shot image representing the real space is acquired. The set of program instructions, when executed by the controller, causes the display apparatus to perform acquiring target information indicating a thread spool of a detection target. Thus, the target information indicating the thread spool of the detection target is acquired. The set of program instructions, when executed by the controller, causes the display apparatus to perform detecting a thread spool position on the shot image for the thread spool of the detection target, based on the shot image and the target information. Thus, the thread spool position on the shot image for the thread spool of the detection target is detected based on the shot image and the target information. The set of program instructions, when executed by the controller, causes the display apparatus to perform generating a display image based on the shot image. The display image indicates the thread spool position. Thus, the display image indicating the thread spool position is generated. The set of program instructions, when executed by the controller, causes the display apparatus to perform displaying the display image on the display. Thus, the display image is displayed on the display. When a user searches for the thread spool of the detection target, the display apparatus allows the user to shoot a group of thread spools owned by the user by using the camera of the display apparatus and to check the display image displayed on the display. This contributes to easily finding the thread spool of the detection target from among the plurality of thread spools arranged at arbitrary locations. According to other aspects, this specification also discloses a display method and a display apparatus.

FIG. 1 is an explanatory diagram of a display system 4 including a terminal apparatus 1, an embroidery sewing machine 2, and a multi-needle sewing machine 5.

FIG. 2 is a block diagram showing an electrical configuration of the display system 4 including the terminal apparatus 1, the embroidery sewing machine 2, and the multi-needle sewing machine 5.

FIG. 3 is an explanatory diagram showing a thread color table T stored in at least the terminal apparatus 1, the embroidery sewing machine 2, or the multi-needle sewing machine 5.

FIG. 5 is an explanatory diagram showing an embroidery pattern E and sewing data D for sewing the embroidery pattern E.

FIG. 6 shows a table QB that stores a correspondence between a needle bar number and a thread color before thread replacement set for each needle bar 67 of the multi-needle sewing machine 5, and a table QA that stores a correspondence between the needle bar number and a thread color after thread replacement, which is set based on the sewing data D.

Figure 1:
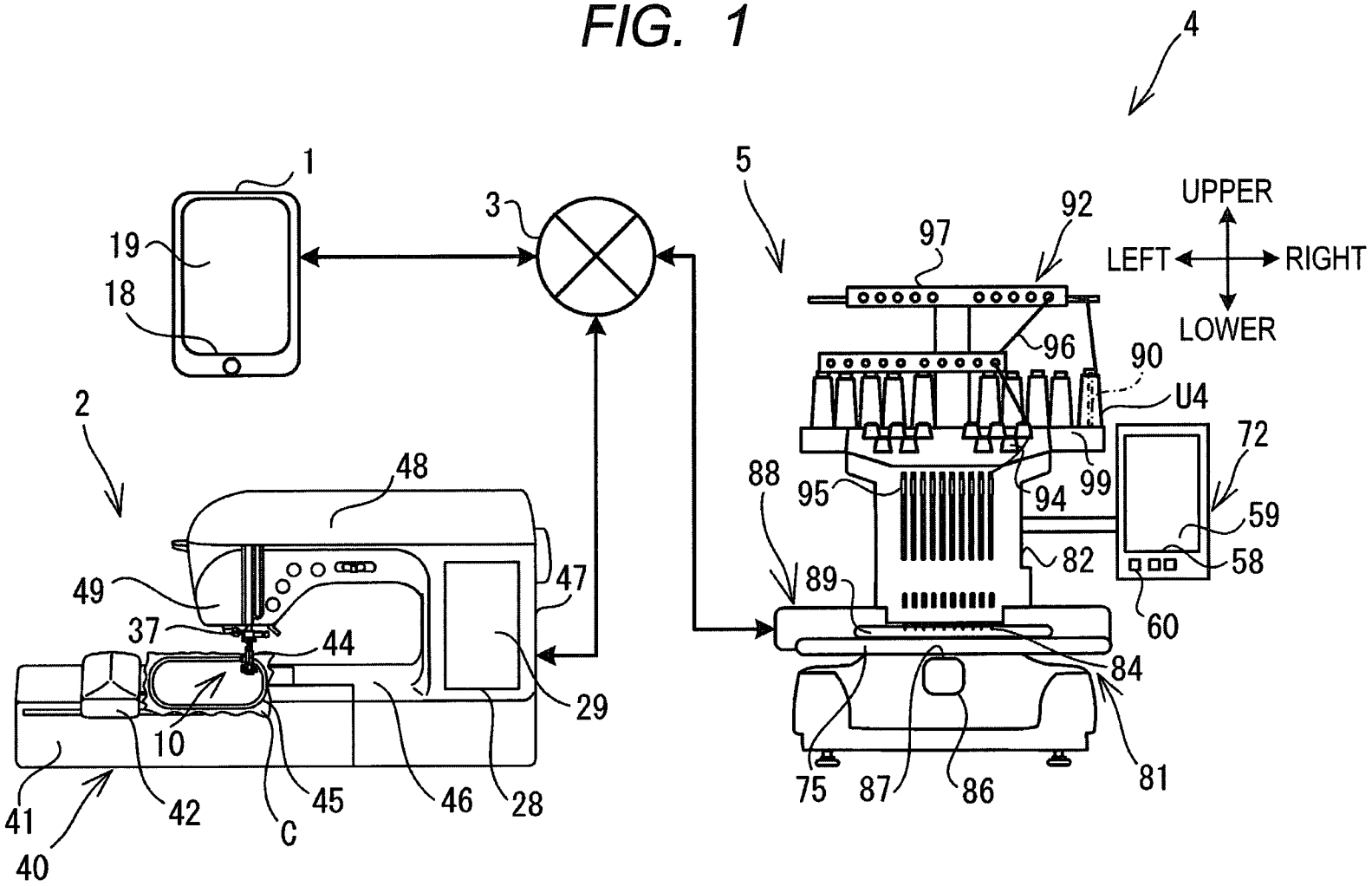

Embodiments of the present disclosure will be described with reference to the drawings. As shown in FIG. 1, a display system 4 (hereinafter referred to as "system 4") includes a terminal apparatus 1, an embroidery sewing machine 2 (hereinafter referred to as "sewing machine 2"), and a multi-needle sewing machine 5 (hereinafter referred to as "sewing machine 5"). The terminal apparatus 1, the sewing machine 2, and the sewing machine 5 perform communication via a network 3.

The terminal apparatus 1 is a tablet-type mobile terminal apparatus or a smart phone that includes a camera (image capturing unit) 11, a display 18, an input interface 19, and a CPU 6. The camera 11 is configured, for example, to generate image data obtained by shooting (photographing) a real space. The display 18 is, for example, a liquid crystal display configured to display an image. The input interface 19 is a touch screen configured to input various instructions. The CPU 6 controls the terminal apparatus 1. The sewing machine 2 includes one needle bar 37 and is capable of sewing embroidery. The sewing machine 5 is a multi-needle sewing machine provided with a plurality of needle bars 67 and capable of sewing embroidery. The terminal apparatus 1 of the system 4 detects thread spools to be used for sewing from an image shot by the terminal apparatus 1 based on sewing order data transmitted from the sewing machine 2 or 5, and notifies about the detection result.

The sewing machine 2 is an embroidery sewing machine provided with one needle bar 37. The sewing machine 2 includes a bed portion 46, a column portion 47, an arm portion 48, a head portion 49, a sewing portion 10, and a movement mechanism 40. The bed portion 46 is a base portion of the sewing machine 2 that extends in a left-right direction. The column portion 47 is erected upward from a right end portion of the bed portion 46. A display 28 and an input interface 29 are provided on the front surface of the column portion 47. The display 28 is, for example, a liquid crystal display configured to display an image. The input interface 29 is a touch screen configured to input various instructions. The arm portion 48 faces the bed portion 46 and extends leftward from the upper end of the column portion 47. The head portion 49 is a portion connected to the left end portion of the arm portion 48. The sewing portion 10 includes the needle bar 37, a presser bar (not shown), a needle bar drive mechanism 36 (see FIG. 2), and so on, in the head portion 49. By moving the needle bar 37 up and down, the sewing portion 10 forms stiches on a sewing material C. A sewing needle 44 is detachably attached to the lower end of the needle bar 37. The sewing portion 10 includes a hook mechanism (not shown) in the bed portion 46.

The movement mechanism 40 is configured to move the sewing material C held by an embroidery frame 45 relative to the needle bar 37. The movement mechanism 40 includes a main body case 41 and a carriage 42. The main body case 41 accommodates an X movement mechanism (not shown). The carriage 42 accommodates a Y movement mechanism (not shown). When sewing embroidery, a user attaches one embroidery frame 45 selected from a plurality of types of embroidery frames 45 having different sizes to the carriage 42. The embroidery frame 45 is moved, by the Y movement mechanism and the X movement mechanism, to a needle drop point indicated by the XY coordinate system (embroidery coordinate system) unique to the sewing machine 2. The sewing machine 2 moves the embroidery frame 45 and drives the needle bar drive mechanism 36 and the hook mechanism of the sewing portion 10 to form an embroidery pattern on the sewing material C held by the embroidery frame 45.

The sewing machine 5 is a multi-needle sewing machine provided with the plurality of needle bars 67. The sewing machine 5 includes a main body 81, a needle bar case 82, a spindle motor 73, a needle bar case motor 68, a plurality of needle bars 67, a needle bar drive mechanism 66, a cylinder bed 86, a needle plate 87, a movement mechanism 88, an operation interface 72, a pair of left and right thread spool bases 99, and a thread guide 92. The main body 81 supports the needle bar case 82 so as to be movable in the left-right direction. The spindle motor 73 and the needle bar case motor 68 are accommodated inside the main body 81. The needle bar case motor 68 moves the needle bar case 82 in the left-right direction. The plurality of needle bars 67 and the needle bar drive mechanism 66 are provided inside the needle bar case 82. The sewing machine 5 of this example has ten needle bars 67. Each of the ten needle bars 67 extends in an upper-lower direction and is arranged at equal intervals in the left-right direction. A sewing needle 84 is attachable to the lower end of each needle bar 67. The needle bar drive mechanism 66 is configured to cause a drive needle bar 67 described later among the plurality of needle bars 67 to vertically slide in accordance with the rotation of the spindle motor 73. The cylinder bed 86 extends in a cylindrical shape in a front-rear direction below the needle bar case 82. A hook and a hook drive mechanism (not shown) are provided at the tip end portion of the cylinder bed 86. The hook drive mechanism drives the hook to rotate. The needle plate 87 is a rectangular plate (in plan view) provided on the upper surface of the cylinder bed 86, and has a needle hole penetrating in the upper-lower direction. Among the plurality of needle bars 67, the needle bar 67 arranged at a drive position directly above the needle hole formed in the needle plate 87 is the drive needle bar 67.

The movement mechanism 88 is provided below the needle bar case 82. The movement mechanism 88 includes a holder 89, an X motor 69 and a Y motor 70. The holder 89 detachably supports one of a plurality of types of embroidery frames including the embroidery frame 75. The embroidery frame 75 detachably holds a sewing material. The sewing material is, for example, a cloth. The movement mechanism 88 uses the X motor 69 and the Y motor 70 as drive sources to move the embroidery frame 75 attached to the holder 89 to a position indicated by the unique XY coordinate system (embroidery coordinate system). The X direction and Y direction of the embroidery coordinate system correspond to the left-right direction and front-rear direction of the sewing machine 5, respectively.

The operation interface 72 is provided on the right side of the main body 81. The operation interface 72 includes a display 58, an input interface 59, and a start-stop switch 60. The display 58 is, for example, a liquid crystal display configured to display an image. The input interface 59 is a touch screen configured to input various instructions. The start-stop switch 60 is used to instruct a start or a stop of sewing.

The pair of left and right thread spool bases 99 are provided on the back side of the upper surface of the main body 81. A plurality of spool pins 90 are provided on each thread spool base 99. The spool pin 90 supports a thread spool U4. A needle thread 96 is supplied from the thread spool U4 set on the thread spool base 99. The needle thread 96 is supplied through the thread guide 92 to the eye of the sewing needle 84 attached to the lower end of the needle bar 67. The thread guide 92 includes a thread guide 97, a thread tensioner 94, and a thread take-up 95.

Figure 2:
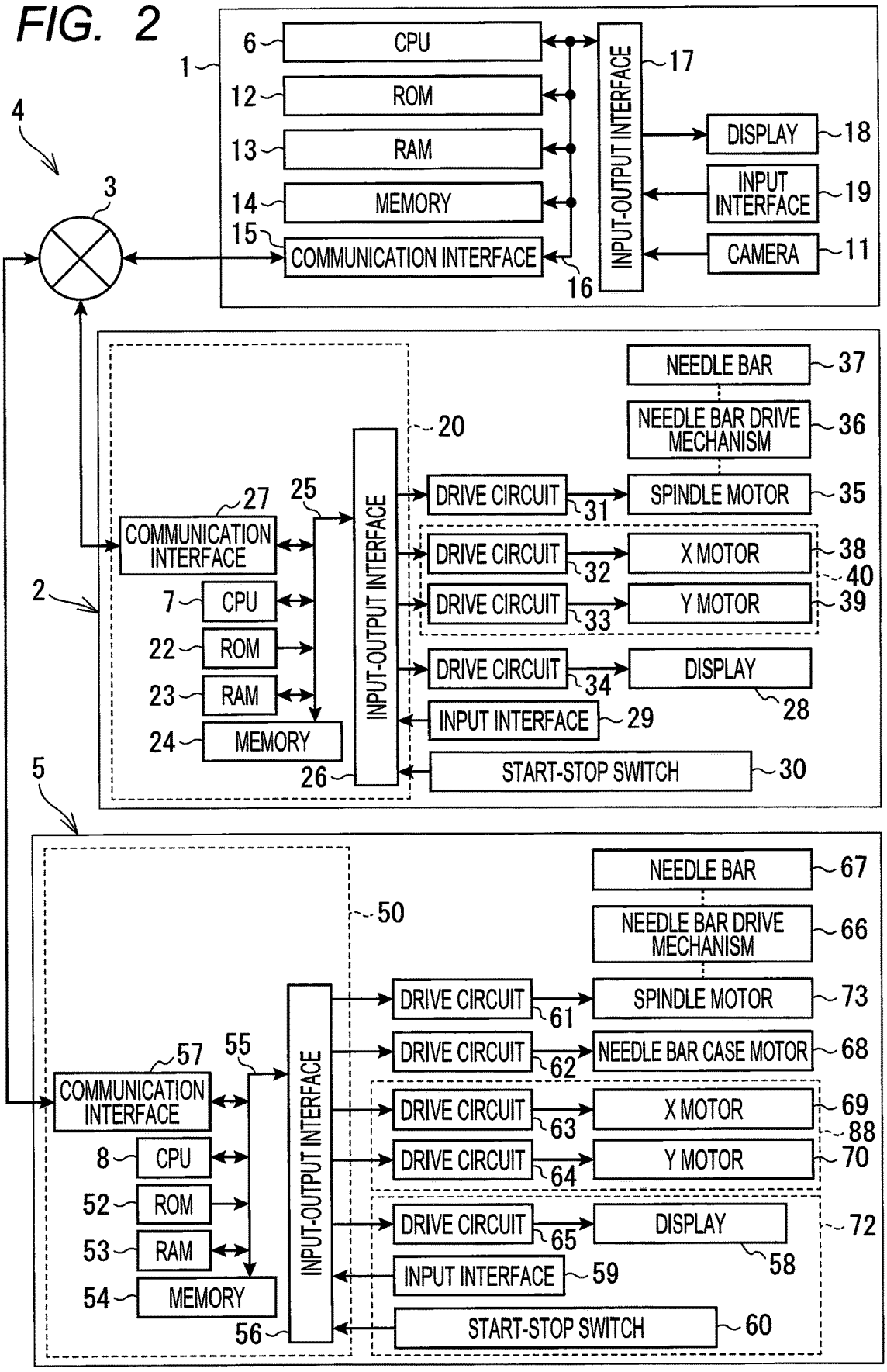

The electrical configuration of the terminal apparatus 1 and the sewing machines 2 and 5 will be described with reference to FIG. 2. The terminal apparatus 1 includes a CPU 6, a ROM 12, a RAM 13, a memory 14, a communication interface 15, and an input-output interface 17. The CPU 6 controls the terminal apparatus 1. The CPU 6 is electrically connected to the ROM 12, the RAM 13, the memory 14, the communication interface 15, and the input-output interface 17 via a bus 16. The ROM 12 stores a boot program, BIOS, and so on. The RAM 13 stores temporary data. The memory (storage) 14 is a non-volatile storage device such as HDD and SSD. The memory 14 stores various setting values necessary for executing a main process described later. The communication interface 15 is an interface for connecting the terminal apparatus 1 to the network 3. The CPU 6 transmits and receives data to and from other devices (for example, the sewing machines 2 and 5) connected to the network 3 via the communication interface 15. The display 18, the input interface 19, and the camera 11 are connected to the input-output interface 17.

The camera 11 is a digital camera that includes an imaging element such as a CCD or CMOS, an imaging lens, and so on.

A controller 20 of the sewing machine 2 includes a CPU 7, a ROM 22, a RAM 23, a memory 24, an input-output interface 26, and a communication interface 27. The CPU 7 is connected to the ROM 22, the RAM 23, the memory 24, the input-output interface 26, and the communication interface 27 via a bus 25. Drive circuits 31 to 34, an input interface 29, and a start-stop switch 30 are connected to the input-output interface 26. The memory 24 is a non-volatile storage device. The memory 24 stores various setting values necessary for executing a sewing machine process described later.

A spindle motor 35 is connected to the drive circuit 31. The drive circuit 31 drives the spindle motor 35 according to control signals from the CPU 7. As the spindle motor 35 is driven, the needle bar drive mechanism 36 is driven via a spindle (not shown) of the sewing machine 2. An X motor 38 is connected to the drive circuit 32. AY motor 39 is connected to the drive circuit 33. The drive circuits 32 and 33 drive the X motor 38 and the Y motor 39, respectively, according to control signals from the CPU 7. As the X motor 38 and the Y motor 39 are driven, the embroidery frame 45 attached to the movement mechanism 40 moves in the left-right direction (X direction) and in the front-rear direction (Y direction) by the movement amount corresponding to the control signals. The drive circuit 34 displays an image on the display 28 according to control signals from the CPU 7. The communication interface 27 connects the sewing machine 2 to the network 3. The CPU 7 transmits and receives data to and from another device (for example, the terminal apparatus 1) connected to the network 3 via the communication interface 27.

The operation of the sewing machine 2 will be briefly described. In the sewing machine 2, the embroidery frame 45 is moved in the X and Y directions by the movement mechanism 40, and the needle bar drive mechanism 36 and the hook mechanism are driven. With this operation, the sewing needle 44 attached to the needle bar 37 sews an embroidery pattern onto the sewing material C held by the embroidery frame 45.

A controller 50 of the sewing machine 5 includes a CPU 8, a ROM 52, a RAM 53, a memory 54, an input-output interface 56, and a communication interface 57. The CPU 8 is connected to the ROM 52, the RAM 53, the memory 54, the input-output interface 56, and the communication interface 57 via a bus 55. Drive circuits 61 to 65, an input interface 59, and a start-stop switch 60 are connected to the input-output interface 56. The memory 54 is a non-volatile storage device. The memory 54 stores various setting values necessary for executing the sewing machine process described later.

The spindle motor 73 is connected to the drive circuit 61. The drive circuit 61 drives the spindle motor 73 according to control signals from the CPU 8. As the spindle motor 73 is driven, the needle bar drive mechanism 66 is driven via a spindle (not shown) of the sewing machine 5, and the drive needle bar 67 moves up and down. The needle bar case motor 68 is connected to the drive circuit 62. The drive circuit 62 drives the needle bar case motor 68 according to control signals from CPU 8 to move the needle bar case 82 in the left-right direction with respect to main body 81. An X motor 69 is connected to the drive circuit 63. A Y motor 70 is connected to the drive circuit 64. The drive circuits 63 and 64 drive the X motor 69 and the Y motor 70, respectively, according to control signals from the CPU 8. As the X motor 69 and the Y motor 70 are driven, the embroidery frame 75 attached to the movement mechanism 88 moves in the left-right direction (X direction) and in the front-rear direction (Y direction) by the movement amount corresponding to the control signals. The drive circuit 65 displays an image on the display 58 according to control signals from the CPU 8. The communication interface 57 connects the sewing machine 5 to the network 3. The CPU 8 transmits and receives data to and from another device (for example, the terminal apparatus 1) connected to the network 3 via the communication interface 57.

The operation of the sewing machine 5 will be briefly described. Due to left and right movement of the needle bar case 82, one of the ten needle bars 67 is selected as the drive needle bar 67. In the sewing machine 5, the embroidery frame 75 is moved in the X direction and the Y direction by the movement mechanism 88, and the needle bar drive mechanism 66 and the hook mechanism are driven. With this operation, the sewing needle 44 attached to the drive needle bar 67 sews an embroidery pattern onto a sewing material held by the embroidery frame 75.

A thread color table T stored in at least the memory 14, 24, or 54 will be described with reference to FIG. 3. The thread color table T includes an identification number T1, a color name T2, and other information T3 of threads used when sewing the embroidery pattern E with the sewing machines 2 and 5. The identification number T1 is represented by, for example, a three-digit number. The other information T3 is, for example, a color code, an indicator such as a figure unique to the thread color, an image of a two-dimensional code corresponding to the identification number T1 or the color name T2, and so on. The two-dimensional code may be appropriately selected from a QR code, VeriCode, a CP code, an AztecCode, a PDF417, and so on. In a case where the thread color table T is stored in the memory 14, the terminal apparatus 1 refers to the thread color table T in the main process described later. In a case where the thread color table T is stored in the memory 24, 54, the sewing machine 2, 5 refers to the thread color table T in the sewing machine process described later. The "QR Code" is a registered trademark of DENSO WAVE INCORPORATED.

The sewing machine process executed by the CPU 7 of the sewing machine 2 or the CPU 8 of the sewing machine 5 of the system 4 will be described with reference to FIGS. 4 to 6.

A step is abbreviated as S below. As an example, a case of sewing an embroidery pattern E represented by sewing data D in FIG. 5 will be described. After the power is turned on, in response to acquiring a thread spool detection start instruction from the user in a state where the embroidery pattern E of the sewing target is selected, the CPU 7 of the sewing machine 2 reads a program stored in the memory 24 into the RAM 23. The CPU 7 executes the sewing machine process having the following steps according to instructions included in the program read into the RAM 23. Similarly, in response to acquiring a thread spool detection start instruction, the CPU 8 of the sewing machine 5 reads the program stored in the memory 54 into the RAM 53, and executes the sewing machine process having the following steps according to the instructions included in the read program. Various data obtained in the process of the sewing machine process are stored in the RAM 23, 53 as appropriate. The thread spool detection start instruction may be received from the terminal apparatus 1 or input from the input interface 29, 59. Although the sewing machine process executed by the CPU 7 of the sewing machine 2 and the sewing machine process executed by the CPU 8 of the sewing machine 5 are executed at different timings, both will be described in parallel for the sake of simplicity. Normally, a thread spool H (see FIG. 8) used in the sewing machine 2 and the thread spool U4 (see FIGS. 1 and 10) used in the sewing machine 5 are different in shape and size from each other. However, the description will be made using the thread spool H for the sake of simplicity.

Figure 4:
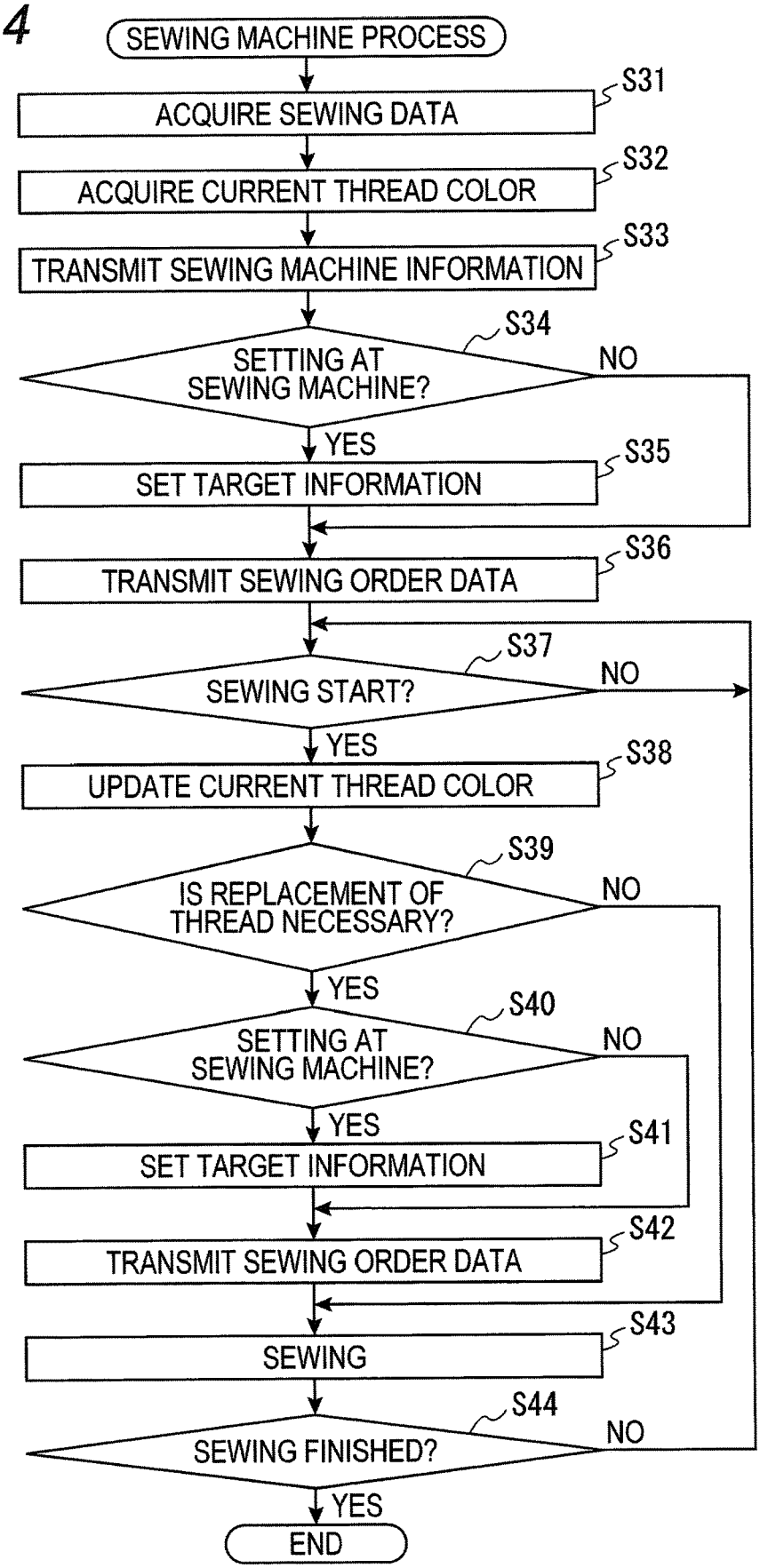
FIG. 4 is a flowchart of a sewing machine process executed by a CPU 7 of the embroidery sewing machine 2 or a CPU 8 of the multi-needle sewing machine 5.

As shown in FIG. 4, the CPU 7, 8 acquires sewing data D for the selected embroidery pattern E (S31). As shown in FIG. 5, the embroidery pattern E is sewn using seven types of thread spools: "BRASS", "LAVENDER", "LILAC", "SALMON PINK", "CARMINE", "LIME GREEN", and "MINT GREEN". The embroidery pattern E has eight partial patterns corresponding to the colors of the thread spool H to be used. The thread spool H of "LILAC" is used for sewing the partial pattern whose sewing order is No. 3 and for sewing the partial pattern whose sewing order is No. 8. The sewing data D includes a sewing order D1, a thread color D2, and coordinate data D3. The sewing order D1 is represented by an integer of 1 or more. The thread color D2 indicates the color of the thread used for sewing a plurality of partial patterns forming the embroidery pattern E. The thread color D2 may be the color name T2 stored in the thread color table T, the thread color identification number T1, or an indicator such as a figure unique to the thread color included in the other information T3. The coordinate data D3 is data representing stitch formation positions set for each partial pattern of the embroidery pattern E, that is, the positions of the needle drop points in coordinates of the embroidery coordinate system. That is, the coordinate data D3 includes a data group representing a plurality of coordinates for each needle drop point. The CPU 7 of the sewing machine 2 acquires the color of the needle thread supplied to the sewing needle 44 attached to the lower end of the needle bar 37, that is, the current thread color (S32). Information on the needle thread supplied to the sewing needle 44 is stored, for example, in the memory 24. The CPU 7 acquires, for example, "BLACK". Similarly, the CPU 8 of the sewing machine 5 acquires the color of the needle thread supplied to the sewing needle 84, that is, the current thread color of each needle bar 67, for each of the ten needle bars 67 (S32). Information on the color of the needle thread supplied to each sewing needle 84 is stored, for example, in the memory 54. The CPU 8 acquires a table QB on the left side of FIG. 6, for example. The table QB stores the correspondence between a needle bar number Q1 and a thread color Q2 supplied to the sewing needle 84 attached to the lower end of needle bar 67 represented by needle bar number Q1. Each needle bar 67 is assigned a number from 1 to 10 in order from the right, as the needle bar number Q1. In the table QB, the needle bars 67 with needle bar numbers Q1 of 1 to 10 are assigned thread colors Q2 of "BLACK", "BROWN", "WHITE", "MINT GREEN", "GREEN", "PINK", "YELLOW", "CARMINE", "LIME GREEN", and "RED," respectively.

The CPU 7, 8 transmits sewing machine information (S33). The sewing machine information includes information indicating the attributes of the sewing machine 2, 5. The sewing machine information includes information representing the number of needle bars. That is, the sewing machine information for the sewing machine 2 includes the number of the needle bar 37, and the sewing machine information for the sewing machine 5 includes the number of the needle bars 67. The sewing machine information may include the sewing order of the partial pattern that is currently sewn. The sewing machine information may include the current thread color acquired in S32. The CPU 7, 8 determines whether target information is to be set at the sewing machine 2, 5 (S34). The target information is information used when detecting the thread spool H used for sewing the embroidery pattern E from the image shot by the terminal apparatus 1, and is information indicating the thread spool H of the detection target. If the target information is not set at the sewing machine 2, 5 (S34: NO), the CPU 7, 8 transmits, to the terminal apparatus 1, data P in which the sewing order D1 and the thread color D2 are associated with each other as sewing order data, based on the sewing data D (S36). The data P is data obtained by removing the coordinate data D3 from the sewing data D.

If the target information is set at the sewing machine 2 (S34: YES), the CPU 7 sets the target information based on the sewing data D acquired in S31 and the current thread color acquired in S32 (S35). If the current thread color is included in the thread colors indicated by the sewing data D acquired in S31, the CPU 7 sets the target information in which the current thread color is excluded from the detection target. For example, the CPU 7 sets the data P including the sewing order D1 and the thread color D2 as the target information. The CPU 7 may set only a thread color R3 of the thread spool H that is next in the sewing order, as the target information. The CPU 7 transmits the data P, which is the target information set in S35, to the terminal apparatus 1 as the sewing order data (S36).

Similarly, if the target information is set at the sewing machine 5 (S34: YES), the CPU 8 sets the target information based on the sewing data D acquired in S31 and the current thread color acquired in S32 (S35). If the current thread color is included in the thread colors indicated by the sewing data D acquired in S31, the CPU 8 sets the target information in which the current thread color is excluded from the detection target. Specifically, the table QA after thread replacement shown on the right side of FIG. 6 includes a needle bar number Q1 and a thread color Q2. As shown in the table QA, the CPU 8 assigns colors that are not included in the current thread colors, among the thread colors indicated by the sewing data D, to the needle bars 67 that are not assigned the current thread colors. Needle bar numbers 4, 8, and 9 represent the needle bars 67 that are assigned thread colors included in the current thread colors among the thread colors indicated by the sewing data D. The needle bars 67 for thread replacement may be selected randomly from the needle bars 67 excluding the needle bar numbers 4, 8, and 9. Alternatively, a frequently-used color (for example, BLACK) may be excluded from the needle bars 67 for thread replacement. In the example in FIG. 6, needle bar numbers 2, 3, 5, and 6 represent the needle bars 67 for thread replacement. That is, in the present embodiment, the target information is set such that the number of thread spools H for thread replacement is minimized. In the table QA, the needle bars 67 with needle bar numbers Q1 of 1 to 10 are assigned thread colors Q2 of "BLACK", "BRASS", "LAVENDER", "MINT GREEN", "LILAC", "SALMON PINK", "YELLOW", "CARMINE", "LIME GREEN," and "RED," respectively. The CPU 8 sets target information R, for example, as shown in FIG. 6. The target information R includes the sewing order R1 of the thread spool H for thread replacement, the needle bar number R2, and the thread color R3 after thread replacement. The CPU 8 transmits the target information R set in S35 to the terminal apparatus 1 as sewing order data (S36).

The CPU 7, 8 determines whether a sewing start instruction has been detected (S37). The user finds the thread spool(s) H to be used for sewing the embroidery pattern E through the main process executed by the terminal apparatus 1, attaches the thread spool(s) H to the sewing machine 2, 5, and then operates the start-stop switch 30, 60 to input a sewing start instruction. If the sewing start instruction is not detected (S37: NO), the CPU 7, 8 waits until the sewing start instruction is detected. If the sewing start instruction is detected (S37: YES), the CPU 7, 8 updates the current thread color (S38). In the case of the sewing machine 2, the CPU 7 overwrites the current thread color stored in the memory 24 with the thread color in the next sewing order based on the sewing data D to update the current thread color. In the case of the sewing machine 5, the CPU 8 overwrites the current thread colors stored in the memory 54 with reference to the table QA after thread replacement to update the current thread colors. When sewing the embroidery pattern E represented by the sewing data D acquired in S31, the CPU 7, 8 determines whether another thread replacement is necessary after sewing of the partial pattern of the current thread color is completed (S39). In S39 after acquiring the instruction to start sewing any of the first to seventh partial patterns in the sewing order, since the next partial pattern to be sewn is sewn with a thread color different from the current thread color, the CPU 7 determines that thread replacement is necessary (S39: YES), and determines whether the target information is to be set at the sewing machine 2 (S40) similarly to S34.

If the target information is not set at the sewing machine 2 (S40: NO), the CPU 7 transmits the data P and the current sewing order to the terminal apparatus 1 as sewing order data (S42). If the target information is set at the sewing machine 2 (S40: YES), the CPU 7 sets the target information based on the sewing data D acquired in S31 and the current thread color updated in S38 (S41). Specifically, the CPU 7 sets, as the target information, the thread color that has not been used before the currently-sewn partial pattern among the thread colors whose sewing orders are later than the currently-sewn partial pattern. In a case where the CPU 8 of the sewing machine 5 executes the processing of S41, the CPU 8 sets, as the target information, the thread color that has not been used before the currently-sewn partial pattern and is not included in the current thread color, among the thread colors whose sewing orders are later than the currently-sewn partial pattern. In this example, the thread color that has been used before the currently-sewn partial pattern among the thread colors whose sewing orders are later than the currently-sewn partial pattern is excluded from the target information. This is because it is presumed that such thread color is in the hands of the user due to reasons such as it is attached to the sewing machine 2, 5 at a start point of the main process or it has been detected in the main process of the terminal apparatus 1 described later. The CPU 7, 8 transmits the target information set in S41 to the terminal apparatus 1 as sewing order data (S42). In S39 after acquiring the instruction to start sewing the eighth partial pattern in the sewing order, since there is no partial pattern to be sewn next, the CPU 7 determines that thread replacement is not necessary (S39: NO), and executes the processing of S43. Also, although not illustrated in this specific example, in a case where the partial pattern to be sewn next is sewn with the same thread color as the current thread color, it is also determined that thread replacement is not necessary.

The CPU 7 of the sewing machine 2 performs sewing of the partial pattern based on the sewing data D (S43). In a specific example, in S43 of the first time, the CPU 7 of the sewing machine 2 drives the movement mechanism 40 and the spindle motor 35 based on the sewing data D, and sews the partial pattern whose thread color is "BRASS" and whose sewing order is the first. On the other hand, the CPU 8 of the sewing machine 5 sequentially sews, based on the sewing data D, one or more partial patterns that can be sewn with the current thread colors of the needle bars 67, that is, a plurality of thread spools H currently attached (S43). In the specific example, the CPU 8 drives the movement mechanism 88, the spindle motor 73, and the needle bar case motor 68, and continuously sews the first partial pattern in the sewing order, whose thread color is "BRASS" to the eighth partial pattern in the sewing order, whose thread color is "LILAC." The CPU 7, 8 determines whether all partial patterns have been sewn based on the sewing data D acquired in S31 (S44). In S44 after any one of the first to seventh partial patterns in the sewing order has been sewn by the sewing machine 2 (S44: NO), since there is a partial pattern to be sewn next, the CPU 7 returns the processing to S37. In S37, the user of the sewing machine 2 inputs a sewing start instruction after replacing the thread spool H to be used for sewing the next partial pattern in the sewing order. In S44 after the eighth partial pattern in the sewing order is sewn by the sewing machine 2 (S44: YES), since there is no partial pattern to be sewn next, the CPU 7 ends the sewing machine process. In S44 after the sewing machine 5 sews the first to eighth partial patterns in the sewing order (S44: YES), since there is no partial pattern to be sewn next, the CPU 8 ends the sewing machine process.

The main process executed by the CPU 6 of the terminal apparatus 1 of the system 4 will be described with reference to FIGS. 5 to 8. A step is abbreviated as S below. After the power is turned on, in response to detecting an operation of a start button B1 displayed on the display 18 in a state where the application is activated, the CPU 6 of the terminal apparatus 1 reads the display program stored in the memory 14 into the RAM 13. The CPU 6 executes the main process having the following steps according to instructions included in the display program read into the RAM 13. As an example, a case where sewing order data for sewing the embroidery pattern E represented by the sewing data D in FIG. 5 is transmitted from the sewing machine 2 or 5 will be described. The main process when the sewing order data is transmitted from the sewing machine 2 and the main process when the sewing order data is transmitted from the sewing machine 5 are executed at different timings, but both will be described in parallel for the sake of simplicity. Normally, the thread spool H (see FIG. 8) used in the sewing machine 2 and the thread spool U4 (see FIGS. 1 and 10) used in the sewing machine 5 are different in shape and size from each other. However, the description will be made using the thread spool H for the sake of simplicity. As shown in FIG. 8, the thread spool H has a main body H1 and a thread H2 wound around the outer circumference of the main body H1. The main body H1 has a cylindrical shape with a through hole H3 formed therein, and flanges H4 and H5 are formed at both ends in the longitudinal direction of the main body H1. A label H6 including a two-dimensional code H7 is attached to the surface of the flange H4. The two-dimensional code H7 represents information indicating the color of the thread H2 wound around the thread spool H. The two-dimensional code H7 may include other information such as a manufacturing number. In the sewing machine 2, the thread spool H is fitted to and supported by a spool pin (not shown) extending in the left-right direction inside the arm portion 48. In the sewing machine 5, the thread spool H is fitted to and supported by the spool pin 90 of the thread spool base 99. The user directs the camera 11 of the terminal apparatus 1 toward a plurality of thread spools H such that the plurality of thread spools H are included within the shooting range of the camera 11.

Figure 7:
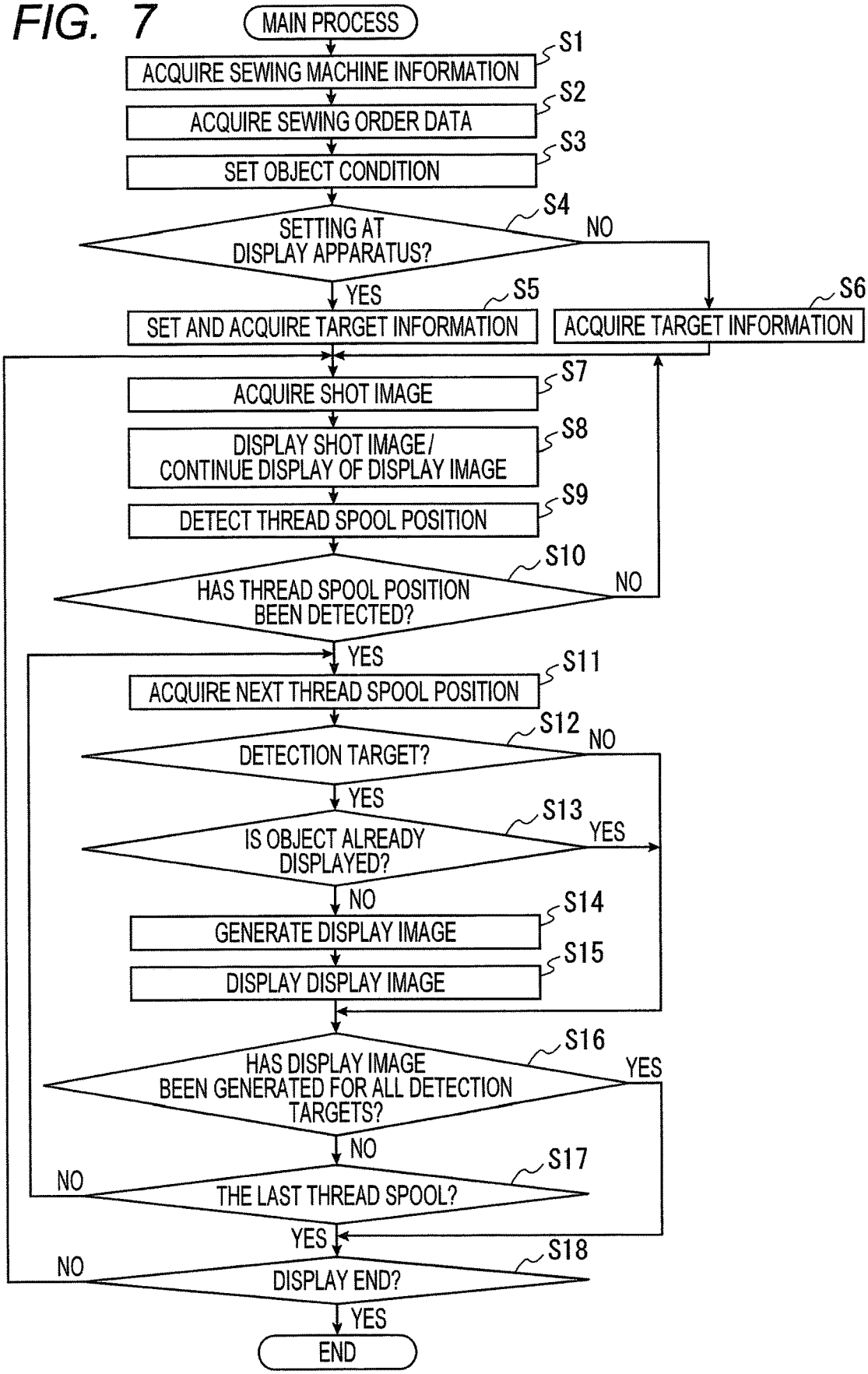
FIG. 7 is a flowchart of a main process executed by a CPU 6 of the terminal apparatus 1.
Figure 8:
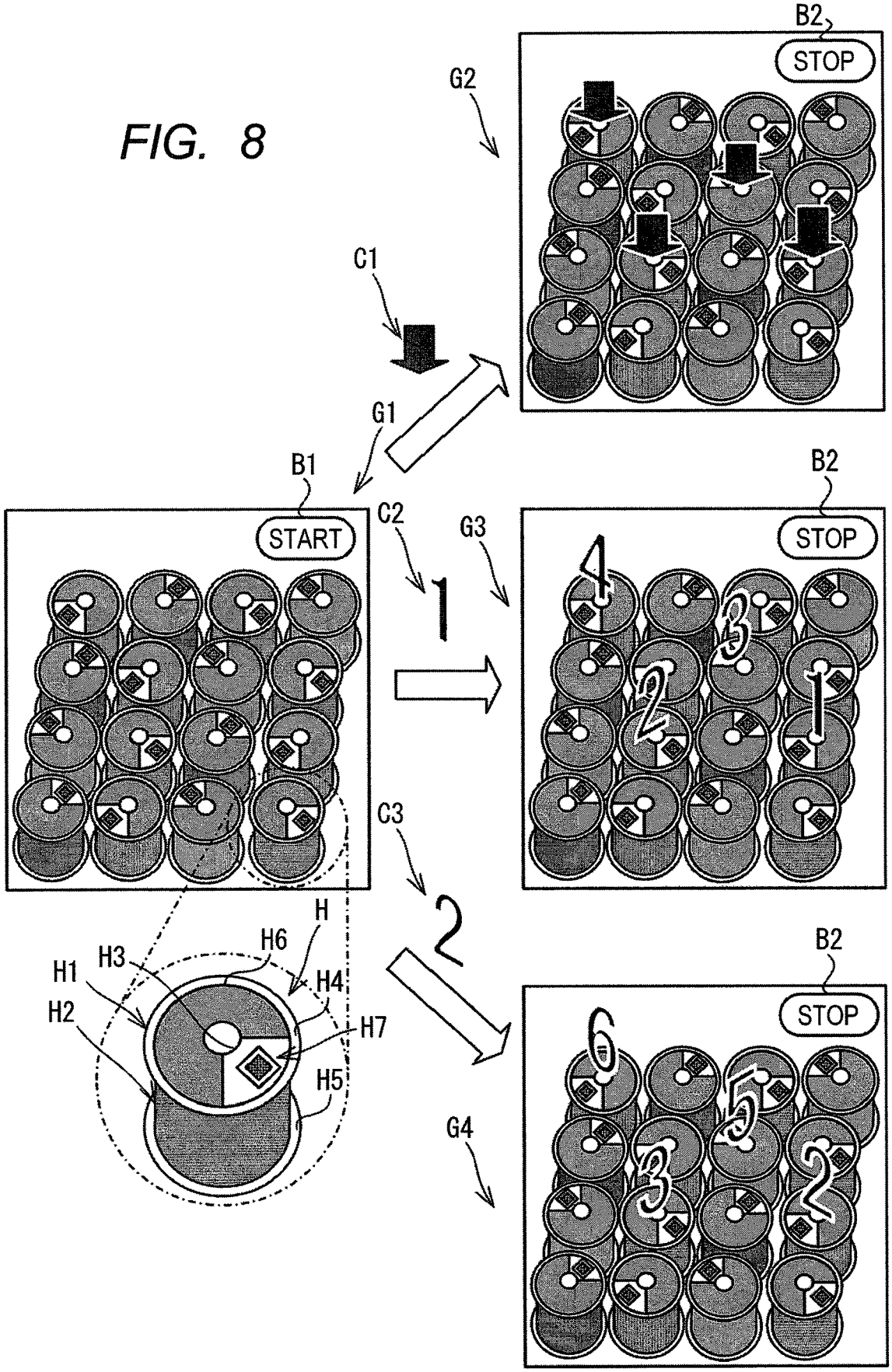
FIG. 8 is an explanatory diagram showing a shot image G1 acquired by a camera 11 and display images G2 to G4 generated based on the shot image G1.

As shown in FIG. 7, the CPU 6 acquires sewing machine information transmitted in S33 of the sewing machine process (S1). The CPU 6 acquires the sewing order data transmitted in S36 or S42 of the sewing machine process (S2). The CPU 6 sets an object condition used for generating a display image (S3). The display image is an image generated based on the shot image taken by the camera 11, and is an image representing a thread spool position of the detection target in the shot image. The object condition is a condition that defines the display mode of the object representing the position of the thread spool H of the detection target in the shot image and the number of displayed objects to be displayed in the display image. In response to acquiring the sewing order data from the sewing machine 2, the terminal apparatus 1 of this example sets, as a display mode, any one of a first condition and a second condition. The first condition is that the position of the through hole H3 of the cylindrical thread spool H is indicated by an arrow. The second condition is that the sewing order in an orientation corresponding to the direction of the thread spool H is indicated by a number above the through hole H3 of the thread spool H. In response to acquiring the sewing order data from the sewing machine 5, the terminal apparatus 1 sets, as the display mode, any one of the first condition, the second condition, and a third condition. The third condition is that a needle bar number in an orientation corresponding to the direction of the thread spool H is indicated by a number above the through hole H3 of the thread spool H. The number of displayed objects defines the number of objects to be displayed. The number of displayed objects is selected from, for example, one (1), a particular number, and the number of unused thread spools H. The number of unused thread spools H is the number of thread spools H that have not been used for sewing among the thread spools H specified by the sewing data D. The object condition may be selectable by the user, or may be automatically set by the CPU 6 according to the sewing machine information, the sewing order data, and so on. The CPU 6 determines whether to set the target information at the terminal apparatus 1 (S4). If the target information is set at the terminal apparatus 1 (S4: YES), the CPU 6 sets the target information in the same manner as in S35 or S41, and acquires the set target information (S5). Specifically, the CPU 6 sets, as the target information, the number of the thread spools H corresponding to the number of displayed objects in the object condition set in S3, the thread spools H having thread colors whose sewing orders are later than the current thread color among the thread spools H indicated by the data P, based on the thread color and the sewing order of the currently-sewn partial pattern included in the sewing machine information acquired in S1 and on the sewing order data acquired in S2. As the target information for the sewing machine 2 in a case where the number of displayed objects is one, the CPU 6 sets, for example, information indicating the first thread spool H in the sewing order as the target information, and acquires the set target information. As the target information for the sewing machine 5 in a case where the number of displayed objects is the number of unused thread spools H, for example, the CPU 6 sets the target information R and acquires the set target information R. If the target information is not set in the terminal apparatus 1 (S4: NO), the CPU 6 acquires the sewing order data acquired in S2 as the target information (S6). The CPU 6 drives the camera 11 to acquire a shot image G1 representing the real space shot by the camera 11 (S7). The user appropriately adjusts the direction of the camera 11 such that at least part of each of the plurality of spools H owned by the user is within the shooting range of the camera 11.

The CPU 6 displays the shot image G1 acquired in S7 on the display 18, or continues to display the display image displayed in the processing of S15 described later (S8). The CPU 6 processes the shot image G1 acquired in S7 and detects the position of the through hole H3 of the thread spool H as the thread spool position (S9). After converting the shot image G1 into an image in which the contrast with the background is emphasized by image processing such as binarization, the CPU 6 extracts a two-dimensional code H7 in the label H6 of the thread spool H from the converted shot image G1, and detects the thread spool position based on the position of the two-dimensional code H7 in the shot image G1. The thread spool position may represent the position of the thread spool H in the shot image G1, and may be indicated by a representative point of the two-dimensional code H7, or may be represented by a representative point of the thread spool H, which is specified based on the position, size, and direction of the two-dimensional code H7. The CPU 6 of this example sets the center of the through hole H3 of the thread spool H as the thread spool position. When a QR code is used as the two-dimensional code H7, the CPU 6 detects the thread spool position using pattern detection of the same fiducial marks arranged at three corners of the four corners of the QR code in the shot image G1. Specifically, the CPU 6 executes processing for detecting a plurality of fiducial marks from the shot image. The CPU 6 detects one or more QR codes from a combination of a plurality of fiducial marks in the image. The CPU 6 detects the direction of the thread spool H from the position of the fiducial mark. The reference for the direction of the thread spool H may be set appropriately.

The CPU 6 determines whether one or more thread spool positions have been detected in the processing of S9 (S10). If no thread spool position has been detected (S10: NO), the CPU 6 returns the processing to S7. The CPU 7 may display a message such as "Please point the camera at thread spools". In the shot image G1 of the specific example, sixteen thread spool positions corresponding to the number of two-dimensional codes H7 are detected (S10: YES), and the CPU 6 acquires the thread spool position which is next in the acquisition order among the thread spool positions detected in S9 (S11). The order of acquiring the thread spool positions in the shot image G1 may be appropriately set. The CPU 6 sets the order of acquiring the thread spool positions, for example, from the left to the right and from the top to the bottom of the shot image G1. The CPU 6 decodes the two-dimensional code H7 of the thread spool position acquired in S11, and determines whether the thread color of the thread spool H indicated by the decoded information is the same as the thread color of the detection target indicated by the target information set in S5 or S6 (S12). If there is a plurality of detection targets, the CPU 6 compares the decoded thread colors with the thread colors of the detection targets in the sewing order, and determines whether the decoded thread color is the same as the thread color of any one of the one or plurality of thread spools included in the detection targets. If the decoded thread color is not the thread color of the detection target (S12: NO), the CPU 6 performs the processing of S16 described later.

If the decoded thread color is the thread color of the detection target (S12: YES), the CPU 6 determines whether an object is already displayed at the thread spool position acquired in S11 (S13). In a case where the embroidery pattern E composed of a plurality of partial patterns is sewn, the thread spool H of one thread color may be used for sewing partial patterns in different sewing orders. As shown in FIG. 5, in the sewing data D of the embroidery pattern E, "LILAC" is included as the thread color used for sewing the third and eighth partial patterns in the sewing orders. The CPU 6 of this example performs the processing of S13 on the thread spool H of the detection target to which a plurality of sewing orders is assigned such that an object representing the earliest sewing order among a plurality of sewing orders assigned to the thread spools H of the detection target is arranged in vicinity of the thread spool position on the shot image G1. The CPU 6 determines that the object is already displayed when the same thread color is assigned to a sewing order that precedes the sewing order corresponding to the thread color of the detection target. If the object is already displayed at the thread spool position acquired in S11 (S13: YES), the CPU 6 performs the processing of S16 described later. If the object is not displayed at the thread spool position acquired in S11 (S13: NO), the CPU 6 generates a display image based on the shot image G1 and indicating the thread spool position acquired in S11 (S14). The CPU 6 sequentially adds the objects of the conditions set in S3 in vicinity of the thread spool position of the detection target in the shot image G1 acquired in S7 to generate a display image. The CPU 6 arranges an object at such a position that the center of the lower side of the minimum rectangle containing the object overlaps the thread spool position. When the object condition is either the second condition or the third condition, the CPU 6 deforms the object specified by the object condition according to the direction of the thread spool H and arranging the object in vicinity of the thread spool position in the shot image G1 to generate a display image. The CPU 6 displays the display image generated in S14 on the display 18 (S15).

The CPU 6 determines whether a display image in which an object is added in vicinity of the thread spool position for all detection targets set in S5 or S6 has been generated (S16). When a display image in which an object is added in vicinity of the thread spool positions for thread spools H of all detection target has been generated (S16: YES), the CPU 6 performs the processing of S18 described later. If an object is not added in vicinity of the thread spool position for at least some of the detection targets (S16: NO), the CPU 6 determines whether all the thread spool positions detected in S9 are acquired in S11 (S17). If some thread spool positions have not been acquired in S11 (S17: NO), the CPU 6 returns the processing to S11.

As shown in FIG. 8, in the object condition of the sewing machine 5, in a case where the number of displayed objects is the number of unused thread spools H and the display mode is set to the first condition, the CPU 6 causes the display 18 to display a display image G2 in which an object C1 is displayed at the thread spool position of the detection target in the shot image G1. The object C1 is an arrow pointing the position of the through hole H3 of the thread spool H having a cylindrical shape. In the object condition, in a case where the number of displayed objects is the number of unused thread spools H and the display mode is set to the second condition, the CPU 6 causes the display 18 to display a display image G3 in which an object C2 is displayed at the thread spool position of the detection target in the shot image G1. The object C2 is a number representing the sewing order in an orientation corresponding to the direction of the thread spool H above the through hole H3 of the thread spool H. In the object condition, in a case where the number of displayed objects is the number of unused thread spools H and the display mode is set to the third condition, the CPU 6 causes the display 18 to display a display image G4 in which an object C3 is displayed at the thread spool position of the detection target in the shot image G1. The object C3 is a number (an example of identification symbol) representing the needle bar number in an orientation corresponding to the direction of the thread spool H above the through hole H3 of the thread spool H. Each of the display images G2 to G4 includes a stop button B2 in the upper right portion. The stop button B2 instructs to end the main process. The object C1 is displayed in a fixed shape regardless of the direction of the thread spool H. The objects C2 and C3 are deformed according to the direction of the thread spool H detected in S9. In the object condition of the sewing machine 2, in a case where the number of displayed objects is a particular number (for example, four) and the display mode is set to the first condition, the CPU 6 generates the display image G2 and displays the display image G2 on the display 18. In the object condition of the sewing machine 2, in a case where the number of displayed objects is a particular number (for example, four) and the display mode is set to the second condition, the CPU 6 generates the display image G3 and displays the display image G3 on the display 18.

Figure 9:
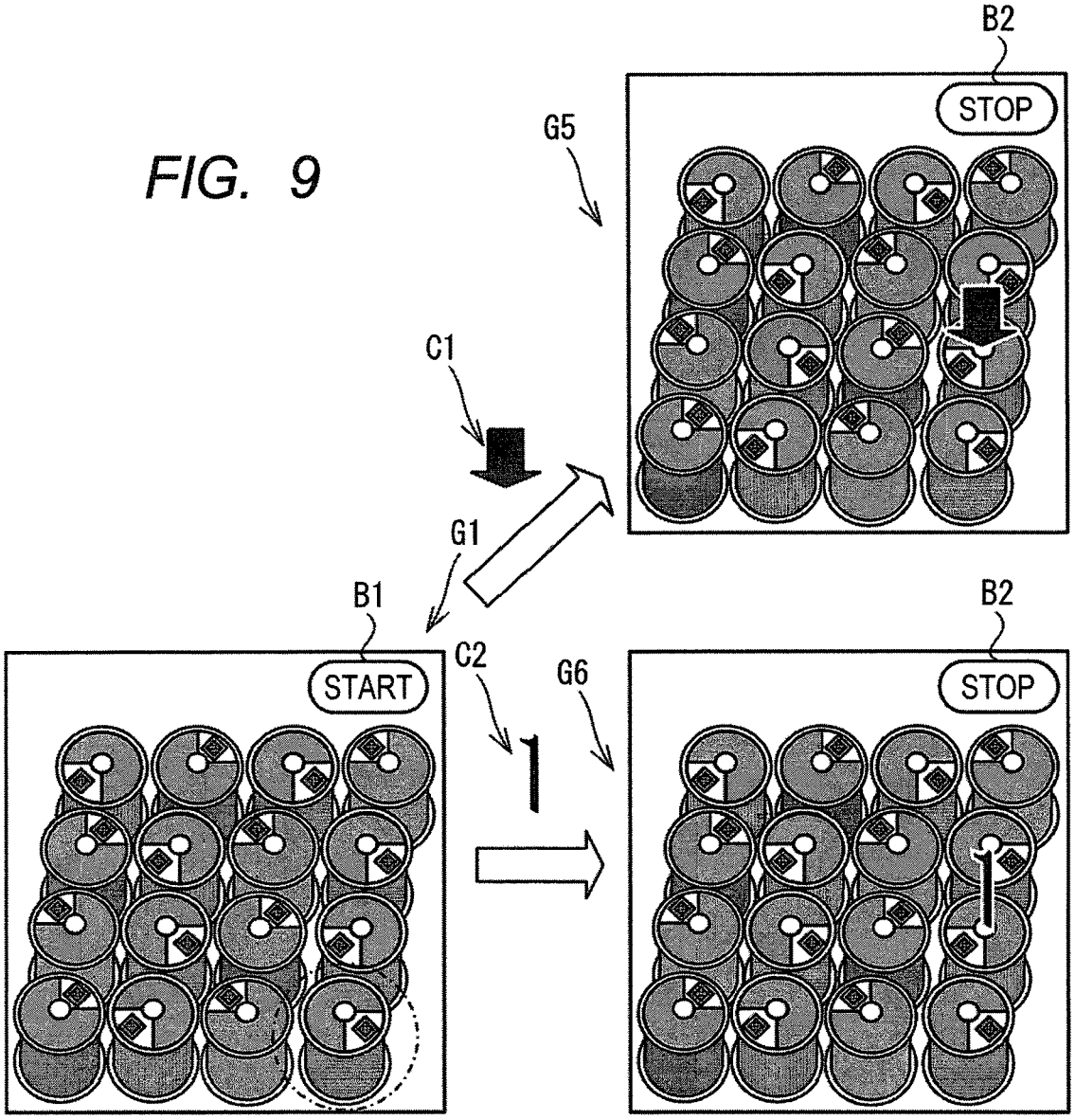
FIG. 9 is an explanatory diagram showing the shot image G1 acquired by the camera 11 and display images G5 and G6 generated based on the shot image G1.

As shown in FIG. 9, in the object condition of the sewing machine 2, in a case where the number of displayed objects is one and the display mode is set to the first condition, the CPU 6 causes the display 18 to display a display image G5 in which the object C1 is displayed at the thread spool position of the detection target in the shot image G1. In the object condition, in a case where the number of displayed objects is one and the display mode is set to the second condition, the CPU 6 causes the display 18 to display the display image G6 in which the object C2 is displayed at the thread spool position of the detection target in the shot image G1. Each of the display images G5 and G6 includes a stop button B2 in the upper right portion. The stop button B2 instructs to end the main process. The object C1 is displayed in a fixed shape regardless of the direction of the thread spool H. The object C2 is deformed according to the direction of the thread spool H.

If all thread spool positions detected in S9 have been acquired in S11 (S17: YES), the CPU 6 determines whether an instruction to end the display of objects has been detected (S18). The user selects the stop button B2 when ending the display of objects. When an instruction to end the display of objects is not detected (S18: NO), the CPU 6 returns the processing to S7. When an instruction to end the display of objects is detected (S18: YES), the CPU 6 ends the main process. After the main process ends, the display image displayed on the display 18 may remain displayed on the display 18 as a still image, or the display on the display 18 may end.

In the above-described embodiment, the terminal apparatus 1, the CPU 6, the camera 11, the communication interface 15, the display 18, and the input interface 19 are examples of a display apparatus, a controller, a camera, a communication interface, a display, and an input interface. The processing of S2 is an example of an image acquisition process and an image acquisition step. The processing of S5 and S6 are examples of an information acquisition process and an information acquisition step. The processing from S9 to S12 is an example of a detection process and a detection step. The processing of S14 is an example of an image generation process and an image generation step. The processing of S15 is an example of a display control process and a display control step.

The terminal apparatus 1 of the system 4 of the embodiment includes the camera 11, the display 18, and the CPU 6.

The CPU 6 executes the following processing according to the display program. The CPU 6 acquires the shot image G1 representing the real space shot by the camera 11 (S7). As an example, the CPU 6 acquires the data P as the target information indicating the thread spool H of the detection target (S5, S6). Based on the shot image G1 and the target information, the CPU 6 detects the thread spool position in the shot image G1 for the thread spool H of the detection target (S9 to S12). The CPU 6 generates the display image G2 based on the shot image G1 and indicating the thread spool position (S14). The CPU 6 displays the display image G2 on the display 18 (S15). The terminal apparatus 1 causes the display 18 to display the display image G2 indicating the position of the thread spool H of the detection target, which is generated based on the shot image G1 representing the real space. Thus, when the user searches for the thread spool H of the detection target, the terminal apparatus 1 allows the user to shoot a group of thread spools H owned by the user by using the camera 11 of the terminal apparatus 1 and to check the display image G2 displayed on the display 18. This contributes to easily finding the thread spool H of the detection target from among the plurality of thread spools H arranged at arbitrary locations.

In the processing from S9 to S12, the CPU 6 detects the thread spool position by detecting the position of the two-dimensional code H7 of the thread spool H of the detection target in the shot image G1, based on the shot image G1 and the target information. The terminal apparatus 1 relatively easily performs the processing of detecting the position of the thread spool H of the detection target from the shot image G1 by performing the detection process using the two-dimensional code H7, which contributes to increasing the detection accuracy.

In the processing of S14, the CPU 6 generates the display image G2 indicating the thread spool position of the detection target by arranging the specific object C1 in vicinity of the thread spool position in the shot image G1. The terminal apparatus 1 generates the display image G2 by relatively simple processing of arranging a specific object in vicinity of the thread spool position in the shot image G1. Thus, the terminal apparatus 1 contributes to helping the user to easily check the position of the thread spool H of the detection target by referring to the specific object C1 in the display image G2. The target information includes the sewing order data that indicates the correspondence between the sewing order and each of a plurality of types of thread spools H in a case where sewing is performed using the plurality of types of thread spools H. In the processing from S9 to S12, the CPU 6 detects the thread spool position with at least a part of each of the plurality of types of thread spools H as the detection target based on the shot image G1 and the target information. In the processing of S14, the CPU 6 generates the display image G2 indicating the thread spool position of the detection target in the shot image G1 for each of the plurality of types of thread spools H. The terminal apparatus 1 contributes to collectively detecting a plurality of types of thread spools H to be used for sewing. Thus, the terminal apparatus 1 contributes to collectively performing the operation of preparing a plurality of types of thread spools H when the user performs sewing using a plurality of types of thread spools H.

In the processing of S14, the CPU 6 arranges the object C2 representing the sewing order corresponding to each of the plurality of types of thread spools H in vicinity of each thread spool position in the shot image G1, thereby generating the display image G3 indicating the thread spool position of the detection target. Since the terminal apparatus 1 displays the objects C2 representing the sewing order of the thread spool H in vicinity of the thread spool H of the detection target, the terminal apparatus 1 contributes to the user's preparation of the thread spools H necessary for sewing according to the sewing data D according to the sewing order. Thus, the terminal apparatus 1 contributes to improving the efficiency of the sewing operation in a case where sewing is performed using a plurality of types of thread spools H, compared to the case where the sewing order is not displayed.

In the processing of S14, the CPU 6 arranges the object C2 representing the earliest sewing order in a plurality of sewing orders assigned to the thread spool H of the detection target among the plurality of types of thread spools H in vicinity of the thread spool position in the shot image G1 based on the sewing order data, thereby generating the display image G3 indicating the thread spool position of the thread spool H of the detection target. In a case where the same thread spool H is used a plurality of times, the terminal apparatus 1 contributes to displaying the thread spool position in an easy-to-understand manner by arranging the object C2 representing the earliest sewing order in vicinity of the thread spool position. The terminal apparatus 1 contributes to improving the efficiency of the operation of specifying the thread spool H necessary for the user, compared to the case where a plurality of objects C2 indicating the sewing order is arranged at the thread spool position of one thread spool H.

In a case where sewing is performed using a plurality of types of thread spools H in the multi-needle sewing machine 5 having the plurality of needle bars 67, the target information R includes needle bar data in which each of a plurality of types of thread spools H is assigned to any one of the plurality of needle bars 67. In the processing of S14, the CPU 6 sets each of the plurality of types of thread spools H as a detection target, and generates the display image G4 indicating the thread spool position of the detection target by arranging the object C3 representing the needle bar 67 corresponding to each of the plurality of types of thread spools H among the plurality of needle bars 67 in vicinity of each thread spool position on the shot image G1. When sewing is performed using the plurality of types of thread spools H in the multi-needle sewing machine 5 having a plurality of needle bars 67, the terminal apparatus 1 contributes to facilitating the user's sewing operation by displaying to which needle bar 67 among the plurality of needle bars 67 the thread spool H displayed in the display image G4 is to be attached.

The terminal apparatus 1 includes the input interface 19 for inputting an instruction to start and stop the shooting (capturing) by the camera 11. The CPU 6 repeatedly executes the processing of S7, the processing of S9 to S12, the processing of S14, and the processing of S15 during the shooting period from when the start instruction is input by the input interface 19 until when the stop instruction is input (S18: NO). Since the terminal apparatus 1 continuously updates the display image in real time during the shooting period and displays the same in AR (Augmented Reality), the terminal apparatus 1 contributes to allowing the user to check the display 18 while changing the shooting range of the camera 11 using the terminal apparatus 1 to find the thread spool H efficiently.

The terminal apparatus 1 has the communication interface 15 for communicating with the sewing machine 2, 5. The thread spool H of the detection target is the thread spool H scheduled to be used first in sewing or the thread spool H scheduled to be used next in sewing. In the processing of S2, the CPU 6 acquires target information from the sewing machine 2, 5 via the communication interface 15. The terminal apparatus 1 communicates with the sewing machine 2, 5 and acquires the target information on the thread spool H to be used first or the thread spool H to be used next in sewing from the sewing machine 2, 5, which contributes to allowing the user to easily prepare the thread spool H necessary first or next.

In the processing from S9 to S12, the CPU 6 detects the thread spool position on the shot image G1 of the thread spool H of the detection target and the direction of the thread spool H, based on the shot image G1 and the target information. In the processing of S14, the CPU 6 generates the display image G3 indicating the thread spool position of the detection target and the direction of the thread spool H by arranging the particular object C2 in vicinity of the thread spool position on the shot image G1 according to the direction of the thread spool H. The terminal apparatus 1 contributes to helping the user to grasp in which direction the thread spool H of the detection target is arranged in the real space based on the direction of the specific object C2 in the display image G3.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described invention are provided below.

The present disclosure may be carried out in various forms, and may be embodied in the form of, for example, a non-transitory computer-readable medium storing a display program, a display system including a display apparatus and a sewing machine, and so on.

(A) The display system 4 may include one of the sewing machines 2 and 5. The type and number of sewing machines included in the display system 4 may be changed as appropriate. The sewing machines 2 and 5 and the terminal apparatus 1 may be connected by wire. The configurations of the sewing machines 2 and 5 may be changed as appropriate. The number of the needle bars 67 of the sewing machine 5 may be changed as appropriate. The configuration of the terminal apparatus 1 may be changed as appropriate, and may be a digital camera and so on, for example. The display 18 of the terminal apparatus 1 may be any display that displays an image, and may be, for example, an organic EL display, a plasma display, a plasma tube array display, an electronic paper display using electrophoresis, and so on. The input interface 19 of the terminal apparatus 1 may be a keyboard, a mouse, a joystick, and so on, in addition to/instead of the touch screen.

(B) The program including instructions for executing the main process of FIG. 7 may be stored in the memory 14 by the time the CPU 6 of the terminal apparatus 1 executes the program. Thus, each of the program acquisition method, the acquisition route, and the device that stores the program may be changed as appropriate. The program executed by each apparatus may be received from another apparatus via cable or wireless communication and stored in a storage device such as a memory. The other apparatuses include, for example, a PC and a server connected via a network. Similarly, the program including instructions for executing the sewing machine process of FIG. 4 may be stored in the corresponding memory 24 or 54 by the time at least the CPU 7 of the sewing machine 2 or the CPU 8 of the sewing machine 5 executes the program. Thus, each of the program acquisition method, the acquisition route, and the device that stores the program may be changed as appropriate. The program executed by each apparatus may be received from another apparatus via cable or wireless communication and stored in a storage device such as a memory.

(C) Each step of the main process is not limited to an example of being executed by the CPU 6, and may be partially or entirely executed by another electronic device (for example, ASIC). Similarly, each step of the sewing machine process is not limited to an example of being executed by the CPU 7 or the CPU 8, and may be partially or entirely executed by another electronic device. Each step of the main process and the sewing machine process may be executed in a distributed manner by a plurality of electronic devices (for example, a plurality of CPUs). The steps of the main process and sewing machine process may be changed in order, omitted, or added as required. The following changes may be added to the main process and the sewing machine process as appropriate.

The main process may include processing when an embroidery pattern is sewn by the sewing machine 2 or processing when an embroidery pattern is sewn by the sewing machine 5. The system 4 may not be configured to select whether the target information is set by the sewing machine 2, 5 or by the terminal apparatus 1, and it may be determined in advance by which apparatus the target information is set.

The thread spool position may be a position indicating a representative point of the thread spool H. The representative point of the thread spool H may be changed as appropriate. The position in vicinity of the thread spool position may be appropriately set according to the definition of the thread spool position, may be a position where the thread spool position and the object overlap, or may be a position where the distance between the thread spool position and the object is within a particular range. The particular range may be appropriately set according to the shape and size of the thread spool H and the shape, size, and arrangement of the object. The particular range is represented by the radius of the flange H4 of the thread spool H, for example. The object may be arranged at a position where a part of the object overlaps the thread spool H. The processing of detecting the thread spool position of the detection target from the shot image G1 may be changed as appropriate. The CPU 6 may apply an identification model generated by machine learning or deep learning to the shot image G1 to identify the shape and size of the thread spool H and the thread color of the thread spool H, thereby detecting the thread spool position of the detection target. In this case, since the color of the thread spool H differs depending on the shooting conditions such as lighting, the shot image G1 may be corrected based on the result of shooting color samples under the shooting conditions in which the main process is executed. The CPU 6 may detect the thread spool position of the detection target by comparing the two-dimensional code H7 of the detection target with the shot image G1 and detecting the two-dimensional code H7 of the detection target from the shot image. In this case, the image of the two-dimensional code H7 of the detection target may be generated by the terminal apparatus 1 or may be generated by the sewing machine 2 or 5 and transmitted to the terminal apparatus 1.

Figure 10:
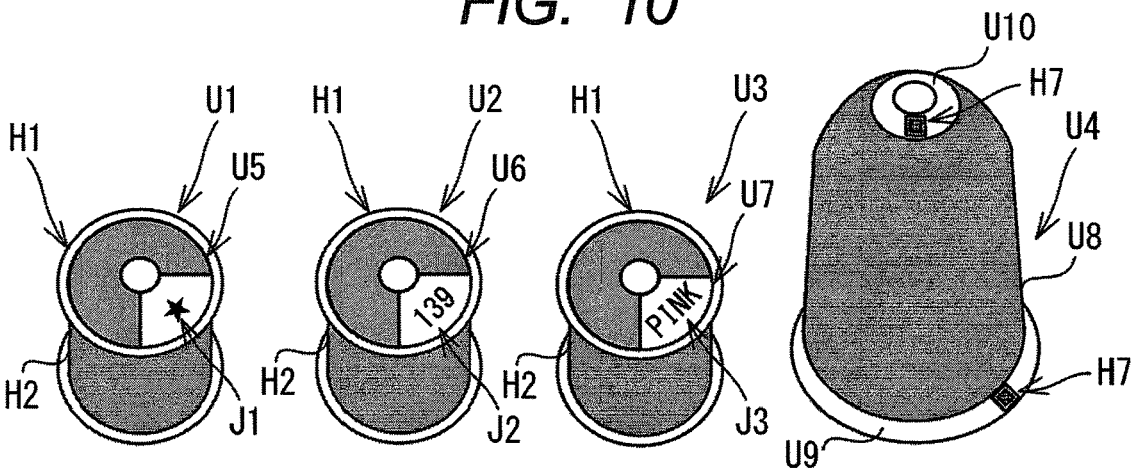
FIG. 10 is an explanatory diagram for illustrating detection of thread spool positions of thread spools U1 to U4.

The thread spool H may be changed as appropriate, such as a thread spool U1 to a thread spool U4 in modifications shown in FIG. 10, and the CPU 6 may change the detection method depending on the thread spool U1 to the thread spool U4. In FIG. 10, the same reference numerals are assigned to the same components as those of the thread spool H. The thread spool U1 has a figure J1 corresponding to the color of the thread H2 of the thread spool U1, arranged on a label U5 attached to the surface of the main body H1. In this case, the CPU 6 may detect the thread spool position by detecting the position of the figure J1 of the thread spool H of the detection target on the shot image. The thread spool U2 has an identification number J2 corresponding to the color of the thread H2 of the thread spool U2, arranged on a label U6 attached to the surface of the main body H1. The identification number J2 is represented by Arabic numerals, for example. In this case, the CPU 6 may detect the thread spool position by performing OCR (Optical Character Recognition/Reader) processing and detecting the position of the identification number J2 of the thread spool H of the detection target on the shot image. The thread spool U3 has a thread color J3 corresponding to the color of the thread H2 of the thread spool U3, arranged on a label U7 attached to the surface of the main body H1. The thread color J3 is represented, for example, by letters of the alphabet. In this case, the CPU 6 may detect the thread spool position by performing OCR processing and detecting the position of the thread color J3 of the thread spool H of the detection target on the shot image. The thread spool U4 is a thread spool attached to the sewing machine 5, and has a flange U9 and a tubular portion U10. A thread U8 is wound around the outer circumference of the tubular portion U10. The thread spool U4 has a two-dimensional code H7 arranged on each of the upper end portion of the tubular portion U10 and the outer peripheral edge of the flange U9. In this case, the CPU 6 may detect the thread spool position by detecting the position of the two-dimensional code H7 of the thread spool H of the detection target on the shot image. In the thread spool U4, the two-dimensional code H7 may be replaced with at least the figure J1, the identification number J2, or the thread color J3.

The target information may include the color of the thread spool H to be used for sewing the next partial pattern in the sewing order, or may include the color of the thread spool H to be used for sewing a particular number of subsequent partial patterns in the sewing order. The particular number may be set by the user, or may be automatically set by the terminal apparatus 1 and the sewing machine 2, 5. The target information may include thread spools of thread colors used before the partial pattern that is currently sewn among the thread colors whose sewing orders are later than the partial pattern that is currently sewn. In a case where the thread spool H that is removed for thread replacement will be used after the partial pattern that is currently sewn in the sewing order, the sewing machine 2, 5 may inform the user that the thread spool H will be used again by displaying the information on the display 28, 58. At least the object C2 or C3 may not be deformed according to the direction of the thread spool H. The object C1 may be deformed according to the direction of the thread spool H.

The object may be a figure other than an arrow, or may be various character strings of the alphabet other than numbers. The object may be a favorite figure set by the user, an original icon, and so on. If the object is a character string, alphabetic letters such as "first" and "second" may represent the sewing order or the needle bar number, or may represent the thread color or the identification number of the thread spool H. The sewing order may be the sewing order of the entire embroidery pattern E, or may represent such an order that the sewing order of the partial pattern that is currently sewn is 0, and the sewing order of the partial pattern to be sewn next to the partial pattern that is currently sewn is 1. The color, size, and arrangement of objects may be changed as appropriate. As for the object color, a color that is not detected in the shot image may be used with priority such that the color stands out in the shot image, or a plurality of colors with high contrast such as yellow with a black border may be used. The object size may be changed according to the size of the thread spool H in the shot image. The objects may be arranged in vicinity of the thread spool H of the detection target and may be arranged on any one of the left, right, lower, diagonally upper right, diagonally upper left, diagonally lower right, and diagonally lower left sides of the thread spool H of the detection target. The color, size, and arrangement of objects may be set by the user, or may be set automatically by the terminal apparatus 1 and the sewing machine 2, 5.

The display image generation method may be changed as appropriate. The thread spool position may not be indicated by an object. For example, the CPU 6 may generate a display image in which the outline of the thread spool H of the detection target in the shot image G1 is emphasized by a line of a particular thickness and a particular color. The CPU 6 may generate a display image in which the color of the thread spool H of the detection target in the shot image G1 is changed or the thread spool H of the detection target blinks, for example. The display image may be generated by arranging objects in vicinity of the detection target in the shot image that has undergone various types of image processing. Various types of image processing include, for example, monochrome processing, grayscale processing, and so on. The update frequency of the display image may be changed as appropriate. The displayed image may be a still image. When the detection target includes a plurality of thread spools H, the CPU 6 may generate a display image for each of the plurality of thread spools H included in the detection target. In a case where the detection target includes a plurality of thread spools H, the CPU 6 may include, in the display image, information indicating whether all of the plurality of thread spools H included in the detection target have been detected and may display the information separately from the display image.

When the embroidery pattern E is sewn by the sewing machine 5, the processing of assigning the thread spool H to the needle bar 67 may be executed by the sewing machine 5 or may be executed by the terminal apparatus 1. The user may be able to switch between display images G2 to G6 having different object conditions. When the two-dimensional code H7 includes the manufacturing number of the thread spool H, and when a plurality of thread spools H of the same color are detected from the shot image G1, the CPU 6 may display an object on the thread spool H with the smallest manufacturing number, that is, the thread spool H with the oldest manufacturing date among the plurality of thread spools H of the same color. When one thread spool H is used for sewing partial patterns with different sewing orders, the CPU 6 may generate a display image in which objects representing not only the earliest sewing order but also two or more sewing orders are arranged in vicinity of the thread spool position. In a state where the object of the earliest sewing order is arranged in vicinity of the thread spool position, the CPU 6 may exclude sewing orders other than the earliest sewing order from the target information and omit the processing of S13. At least the sewing order data or the sewing machine information may not be acquired from the sewing machine 2, 5 and may be manually input by the user via the input interface 19. In that case, the terminal apparatus 1 may not include the communication interface 15 and may not be configured to communicate with the sewing machine 2, 5. The current thread colors of the sewing machine 2, 5 may be detected based on the shot image of the terminal apparatus 1.

The two-dimensional code H7 represents information indicating the color of the thread H2 wound around the thread spool H, but is not limited to this configuration as long as the thread spool H is identified. For example, the two-dimensional code H7 may be information such as the identification number T1. The above modifications may be combined as appropriate to the extent that there is no contradiction.

What is claimed is:

1. A non-transitory computer-readable storage medium storing a display program including a set of program instructions for a display apparatus comprising a camera, a display, and a controller, the set of program instructions, when executed by the controller, causing the display apparatus to perform:

acquiring a shot image representing a real space, the shot image being an image shot by the camera;

acquiring target information indicating a thread spool of a detection target;

detecting a thread spool position on the shot image for the thread spool of the detection target, based on the shot image and the target information;

generating a display image, the display image including the shot image and a particular object indicating the thread spool position; and displaying the display image on the display.

2. The non-transitory computer-readable storage medium according to claim 1, wherein the detecting the thread spool position includes detecting a position of a two-dimensional code of the thread spool of the detection target on the shot image based on the shot image and the target information.

3. The non-transitory computer-readable storage medium according to claim 1, wherein the generating the display image includes arranging the particular object in vicinity of the thread spool position on the shot image.

4. The non-transitory computer-readable storage medium according to claim 1, wherein the target information includes sewing order data indicating a correspondence between a sewing order in a case where sewing is performed using a plurality of types of thread spools and each of the plurality of types of thread spools;

wherein the detecting the thread spool position includes detecting the thread spool position based on the shot image and the target information, the detection target being at least part of each of the plurality of types of thread spools; and wherein the generating the display image includes generating the display image indicating the thread spool position on the shot image for each of the plurality of types of thread spools of the detection target.

5. The non-transitory computer-readable storage medium according to claim 4, wherein the generating the display image includes arranging the particular object indicating the sewing order corresponding to each of the plurality of types of thread spools of the detection target in vicinity of the thread spool position on the shot image.

6. The non-transitory computer-readable storage medium according to claim 5, wherein the generating the display image includes arranging, based on the sewing order data, arranging a first object in vicinity of the thread spool position on the shot image, the first object being the particular object representing first in the sewing order assigned to the plurality of types of thread spools of the detection target.

7. The non-transitory computer-readable storage medium according to claim 1, wherein the target information includes needle bar data in which each of a plurality of types of thread spools is assigned to one of a plurality of needle bars of a multi-needle sewing machine in a case where sewing is performed using the plurality of types of thread spools; and wherein the generating the display image includes arranging the particular object indicating a needle bar corresponding to each of the plurality of types of thread spools of the detection target in vicinity of the thread spool position of each of the plurality of types of thread spools of the detection target on the shot image, the detection target being at least part of each of the plurality of types of thread spools.

8. The non-transitory computer-readable storage medium according to claim 1, wherein the display apparatus further comprises an input interface for inputting a start instruction and a stop instruction of shooting by the camera; and wherein the set of program instructions, when executed by the controller, causes the display apparatus to repeat the acquiring the shot image, the detecting the thread spool position, the generating the display image, and the displaying the display image during a shooting period from when the start instruction is input by the input interface to when the stop instruction is input by the input interface.

9. The non-transitory computer-readable storage medium according to claim 1, wherein the display apparatus further comprises a communication interface for communicating with a sewing machine;

wherein the thread spool of the detection target is the thread spool that is used first in sewing or the thread spool that is used next in sewing; and wherein the acquiring the target information includes acquiring the target information from the sewing machine via the communication interface.

10. The non-transitory computer-readable storage medium according to claim 3, wherein the detecting the thread spool position includes detecting the thread spool position and an orientation of the thread spool of the detection target, based on the shot image and the target information; and wherein the generating the display image includes arranging the particular object to indicate the orientation of the thread spool in vicinity of the thread spool position on the shot image, thereby generating the display image indicating the thread spool position and the orientation of the thread spool of the detection target.

11. The non-transitory computer-readable storage medium according to claim 1, wherein the target information includes needle bar data in which each of a plurality of types of thread spools is assigned to one of a plurality of needle bars of a multi-needle sewing machine in a case where sewing is performed using the plurality of types of thread spools; and wherein the acquiring the target information includes:

acquiring first data indicating a first set of thread spools to be used for the sewing;

acquiring second data indicating a second set of thread spools already attached to the multi-needle sewing machine; and acquiring, as the target information, third data indicating a third set of thread spools by excluding thread spools included in the second set of thread spools from the first set of thread spools.

12. The non-transitory computer-readable storage medium according to claim 11, wherein the generating the display image includes:

assigning the thread spools of the third set to non-assigned needle bars to which none of the thread spools of the first set is assigned, the non-assigned needle bars being among the plurality of needle bars; and arranging the particular object in vicinity of the thread spool position of each of the thread spools of the third set on the shot image, the particular object being an identification symbol for identifying each of the non-assigned needle bars.

13. A display method performed by a controller of a display apparatus comprising a camera and a display, the display method comprising:

acquiring a shot image representing a real space, the shot image being an image shot by the camera;

acquiring target information indicating a thread spool of a detection target;

detecting a thread spool position on the shot image for the thread spool of the detection target, based on the shot image and the target information;

generating a display image, the display image including the shot image and a particular object indicating the thread spool position; and displaying the display image on the display.

14. A display apparatus comprising:

a camera;

a display; and a controller configured to perform:

acquiring a shot image representing a real space, the shot image being an image shot by the camera;

acquiring target information indicating a thread spool of a detection target;

detecting a thread spool position on the shot image for the thread spool of the detection target, based on the shot image and the target information;

generating a display image, the display image including the shot image and a particular object indicating the thread spool position; and displaying the display image on the display.

15. The non-transitory computer-readable storage medium according to claim 1, wherein the particular object is an icon indicating the thread spool of the detection target.

16. The non-transitory computer-readable storage medium according to claim 1, wherein the thread spool of the detection target is a plurality of types of thread spools in a case where sewing is performed using thread spools including the plurality of types of thread spools; and wherein the particular object is characters indicating sewing orders of the plurality of types of thread spools of the detection target.

17. The non-transitory computer-readable storage medium according to claim 1, wherein the thread spool of the detection target is a plurality of types of thread spools in a case where sewing is performed using thread spools including the plurality of types of thread spools; and wherein the display image is an image in which the particular object for each of the plurality of types of thread spools of the detection target is arranged in vicinity of the thread spool position of a corresponding thread spool on the shot image.

18. The non-transitory computer-readable storage medium according to claim 3, wherein the shot image includes the thread spool of the detection target; and wherein the display image is an image in which the particular object is arranged to overlap the thread spool of the detection target on the shot image.

19. The method according to claim 13, wherein the display image is an image in which the particular object is arranged in vicinity of the thread spool position on the shot image.

20. The method according to claim 19, wherein the shot image includes the thread spool of the detection target; and wherein the display image is an image in which the particular object is arranged to overlap the thread spool of the detection target on the shot image.

* * * * *